US010450987B2

(12) United States Patent
Tordin et al.

(10) Patent No.: US 10,450,987 B2
(45) Date of Patent: Oct. 22, 2019

(54) METHOD OF OPERATING A FUEL INJECTOR

(71) Applicant: GM GLOBAL TECHNOLOGY OPERATIONS LLC, Detroit, MI (US)

(72) Inventors: Serena Tordin, Settimo Torinese (IT); Valerio Nuzzo, Turin (IT); Paul Leonardo Claude, Turin (IT); Angelo Cancellieri, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 287 days.

(21) Appl. No.: 15/298,888

(22) Filed: Oct. 20, 2016

(65) Prior Publication Data

US 2017/0107927 A1 Apr. 20, 2017

(30) Foreign Application Priority Data

Oct. 20, 2015 (GB) ..... 1518549.9

(51) Int. Cl.
*F02D 41/24* (2006.01)
*F02D 41/14* (2006.01)
(Continued)

(52) U.S. Cl.
CPC ..... *F02D 41/2464* (2013.01); *F02D 41/1454* (2013.01); *F02D 41/1456* (2013.01);
(Continued)

(58) Field of Classification Search
CPC ..... F02D 41/1454; F02D 41/2429; F02D 41/2432; F02D 41/2438; F02D 41/2454;
(Continued)

(56) References Cited

U.S. PATENT DOCUMENTS 4,792,905 A * 12/1988 Sekozawa ..... F02D 41/047 123/478
6,513,485 B2 * 2/2003 Ogawa ..... F02D 41/005 123/295

(Continued)

FOREIGN PATENT DOCUMENTS

| | | | |
|---|---|---|---|
| JP | S61116044 | A | 6/1986 |
| JP | S6394048 | A | 4/1988 |
| JP | S63120836 | A | 5/1988 |
| JP | H02104945 | A | 4/1990 |
| JP | H04116237 | A | 4/1992 |
| JP | 2006112291 | A | 4/2006 |

OTHER PUBLICATIONS

Great Britain Patent Office, Great Britain Search Report for Great Britain Application No. 1518549.9, dated Nov. 20, 2015.

*Primary Examiner* — Erick R Solis
*Assistant Examiner* — Robert A Werner
(74) *Attorney, Agent, or Firm* — Lorenz & Kopf, LLP

(57) ABSTRACT

A method of operating a fuel injector of an internal combustion engine includes setting a value of a target fuel quantity to be injected by the fuel injector, initializing a value of a fuel quantity requested from the fuel injector to the value of the target fuel quantity, and correcting the value of the requested fuel quantity. A first learning cycle is performed to correct the value of the requested fuel quantity in which a difference between the target fuel quantity and the injected fuel quantity is calculated and added to the requested fuel quantity to provide a corrected value. The corrected value of the requested fuel quantity is used to determine a reference value of an energizing time that causes the fuel injector to inject a fuel quantity corresponding to the target fuel quantity. The fuel injector is operated based on the determined reference value of the energizing time.

6 Claims, 2 Drawing Sheets

(51) Int. Cl.

| | |
|---|---|
| *F02D 41/12* | (2006.01) |
| *F02D 41/18* | (2006.01) |
| *F02D 41/40* | (2006.01) |
| *F02D 41/38* | (2006.01) |

(52) U.S. Cl.
CPC ..... *F02D 41/247* (2013.01); *F02D 41/248* (2013.01); *F02D 41/2432* (2013.01); *F02D 41/123* (2013.01); *F02D 41/182* (2013.01); *F02D 41/402* (2013.01); *F02D 2041/389* (2013.01); *F02D 2200/0406* (2013.01); *F02D 2200/0414* (2013.01); *F02D 2200/0602* (2013.01); *F02D 2200/0616* (2013.01); *F02D 2250/31* (2013.01)

(58) Field of Classification Search
CPC .. F02D 41/2464; F02D 41/2467; F02D 41/30; F02D 41/34; F02D 41/40; F02D 2200/0614; F02D 2200/0616
USPC ..... 701/103, 104, 109; 123/478, 672, 673; 60/274, 276, 285
See application file for complete search history.

(56) References Cited

U.S. PATENT DOCUMENTS

| | | | | |
|---|---|---|---|---|
| 8,640,681 | B2 * | 2/2014 | Kawai | F02D 41/0002 123/575 |
| 2014/0288805 | A1 * | 9/2014 | Fujime | F02D 41/3005 701/104 |
| 2015/0032359 | A1 * | 1/2015 | Tordin | F02D 41/1456 701/104 |

* cited by examiner

METHOD OF OPERATING A FUEL INJECTOR

CROSS-REFERENCE TO RELATED APPLICATION

This application claims priority to Great Britain Patent Application No. 1518549.9, filed Oct. 20, 2015, which is incorporated herein by reference in its entirety.

TECHNICAL FIELD

The present disclosure pertains to a method of operating a fuel injector of an internal combustion engine, in particular a method of operating a fuel injector of an internal combustion engine (e.g. gasoline engine or Diesel engine) of a motor vehicle.

BACKGROUND

Conventional internal combustion engines may include a fuel injection system for directly injecting fuel into the combustion chambers of the internal combustion engine. The fuel injection control includes several strategies. One such strategy is a small quantities adjustment (SQA) strategy, namely a strategy for compensating small fuel injections, such as for example pilot injections. The SQA-strategy may be based on a learning phase and a correction phase. The duration of the known learning phase, however, is not deterministic and the time to reach a learning convergence (i.e. to satisfy the above disclosed condition) may be long and indefinite, In order to comply with specific regulation requirements related to injection fuel quantity and energizing time monitoring, a need exists for an improved SQA strategy that allows a faster and more accurate learning phase thereof.

Accordingly, it is desirable to provide an improved small quantity adjustment strategy allowing a fast learning phase so that the fuel injectors can perform more accurate fuel injections also during the normal operation of the internal combustion engine.

SUMMARY

An embodiment of the disclosure provides a method of operating a fuel injector of an internal combustion engine in which a value of a target fuel quantity to be injected by the fuel injector is set, a value of a fuel quantity requested from the fuel injector to the value of the target fuel quantity is initialized, and the value of the requested fuel quantity is corrected. The correction of the value of the requested fuel quantity includes performing a first learning cycle, in which a value of an energizing time corresponding to the value of the requested fuel quantity is determined, a fuel injection is performed by energizing the fuel injector for the determined value of energizing time, a value of an oxygen concentration in an exhaust gas is measured, a value for a fuel quantity that has been injected by the fuel injector is determined as a function of the measured value of the oxygen concentration, a difference between the value of the target fuel quantity and the value of the injected fuel quantity is calculated, and the value of the requested fuel quantity is added to the calculated difference. The corrected value of the requested fuel quantity is used to determine a reference value of an energizing time that causes the fuel injector to inject the target fuel quantity, and the fuel injector is operated on the basis of the determined reference value of the energizing time.

As a result of this solution, the first learning cycle determines a corrected value of the energizing time which is closer to the target fuel quantity with respect to the known learning phases, thereby allowing a fast and more accurate learning phase. Again, as a result of this solution, the method, being based on an oxygen concentration measurement, may take into account the driveline disturbances, such as the road roughness and the driveline configuration, or loads, such as loads connected to the power take-off of the vehicle. Moreover, as a result of this solution, the method require less calibration efforts than the known methods and the amount of fuel to be injected by a fuel injector into the combustion chamber of the internal combustion engine may be controlled and corrected with few calibration effort and few computation power.

According to an embodiment, the correction of the value of the requested fuel quantity includes performing the first learning cycle for a predetermined number of times included between 1 and 5 times. As a result of this solution, the first learning cycle may increase the accuracy of the learning phase and, at the same time, have a duration deterministic and repeatable complying with the most important legislation requirements. Moreover, the first learning cycle reaches a learning convergence in few numbers of cycles and therefore is faster than the known learning cycles. As a consequence, the number of fuel cu-off conditions in which the small injections are injected may be reduced, with a consequent reduction of the fuel consumption.

According to an embodiment, the value of the injected fuel quantity may be calculated by means of the following formula:

$$Qa = k\frac{\dot{m}}{\lambda m},$$

Wherein:

- Qa is the value of the fuel quantity injected during the fuel injection,
- $\dot{m}$ in is an amount of air disposed into the combustion chamber during the fuel injection,
- λm is the measured quantity of oxygen concentration, and
- k is a proportionality constant, which preferably may be calculated according the following formula:

$$k = \frac{Nc/Np}{\alpha s * \rho},$$

Wherein:

- Nc is a number of combustion chambers of the internal combustion engine,
- Np is a number of energizing pulses of the fuel injector to perform a fuel injection, and
- αs is the value of a stoichiometric air to fuel ratio, and
- ρ is a value of a density of the fuel.

In this way, it is provided a simple and reliable solution for calculating the value of the injected fuel quantity requiring little calibration effort and little computation power.

According to a further embodiment, the determination of the reference value of the energizing time may determine a value of an energizing time corresponding to the corrected value of the requested fuel quantity, and perform a second learning cycle in which a fuel injection is performed by energizing the fuel injector for the determined value of energizing time, a value of an oxygen concentration in an exhaust gas is measured, the determined value of the energizing time is increased by a predetermined amount and repeat the second learning cycle, if the measured value of the oxygen concentration is larger than an expected value thereof, the determined value of the energizing time is decreased by the predetermined amount and repeat the second learning cycle, if the measured value of the oxygen concentration is smaller than the expected value, and the determined value of the energizing time is identified as the reference value thereof, if the measured value of the oxygen concentration is equal to the expected value thereof.

As a result of this solution, also the second learning cycle, which may be a standard and known learning cycle, having as input the value of the energizing time determined on the basis of the corrected value of the requested fuel quantity which is an output of the last of the first learning cycles, may have a faster learning convergence and may be more accurate than the known learning cycles.

The proposed solution, achieving basically the same effects of the method described above, may be carried out with the help of a computer program including a program-code for carrying out, when run on a computer, all the steps of the method described above, and in the form of a computer program product including the computer program. The method can be also embodied as an electromagnetic signal, the signal being modulated to carry a sequence of data bits which represent a computer program to carry out all steps of the method.

Another embodiment of the solution, achieving basically the same effects of the method described above, provides an internal combustion engine equipped with a combustion chamber, a fuel injector, an exhaust gas aftertreatment system, an oxygen sensor and an electronic control unit connected to the fuel injector and the oxygen sensor and configured to carry out the method as above disclosed.

Another embodiment of the solution provides an apparatus for operating a fuel injector of an internal combustion engine, wherein the apparatus is configured to set a value of a target fuel quantity to be injected by the fuel injector, initialize a value of a fuel quantity requested from the fuel injector to the value of the target fuel quantity, and correct the value of the requested fuel quantity. For correcting the value of the requested fuel quantity, the apparatus is configured to perform a first learning cycle in which a value of an energizing time corresponding to the value of the requested fuel quantity is determined, a fuel injection is performed by energizing the fuel injector for the determined value of energizing time, a value of an oxygen concentration in an exhaust gas is measured, a value for a fuel quantity that has been injected by the fuel injector is determined as a function of the measured value of the oxygen concentration, a difference between the value of the target fuel quantity and the value of the injected fuel quantity is calculated, and the value of the requested fuel quantity is added to the calculated difference. The apparatus is further configured to use the corrected value of the requested fuel quantity to determine a reference value of an energizing time that causes the fuel injector to inject a the target fuel quantity, and operate the fuel injector on the basis of the determined reference value of the energizing time.

As a result of this solution, the first learning cycle determines a corrected value of the energizing time which is closer to the target fuel quantity with respect to the known learning phases, thereby allowing a fast and more accurate learning phase. Again, thanks to this solution, the apparatus, being based on an oxygen concentration measurement, may take into account the driveline disturbances, such as the road roughness and the driveline configuration, or loads, such as loads connected to the power take-off of the vehicle. Moreover, as a result of this solution, the apparatus require less calibration efforts than the known apparatuses and the amount of fuel to be injected by a fuel injector into the combustion chamber of the internal combustion engine may be controlled and corrected with little calibration effort and little computation power.

According to an embodiment, the correction of the value of the requested fuel quantity includes performing the first learning cycle for a predetermined number of times included between 1 and 5 times. As a result of this solution, the first learning cycle may increase the accuracy of the learning phase and, at the same time, have a duration deterministic and repeatable complying with the most important legislation requirements. Moreover, the first learning cycle reaches a learning convergence in few numbers of cycles and therefore is faster than the known learning cycles. As a consequence, the number of fuel cu-off conditions in which the small injections are injected may be reduced, with a consequent reduction of the fuel consumption.

According to an embodiment, the value of the injected fuel quantity may be calculated by means of the following formula:

$$Qa = k\frac{\dot{m}}{\lambda m},$$

Wherein:

Qa is the value of the fuel quantity injected during the fuel injection, $\dot{m}$ is an amount of air disposed into the combustion chamber during the fuel injection, $\lambda m$ is the measured quantity of oxygen concentration, and k is a proportionality constant, which preferably may be calculated according the following formula:

$$k = \frac{Nc/Np}{\alpha s * \rho},$$

Wherein:

Nc is a number of combustion chambers of the internal combustion engine,

Np is a number of energizing pulses of the fuel injector to perform a fuel injection, and $\alpha s$ is the value of a stoichiometric air to fuel ratio, and $\rho$ is a value of a density of the fuel.

In this way, it is provided a simple and reliable solution for calculating the value of the injected fuel quantity requiring little calibration effort and little computation power.

According to a further embodiment, the apparatus is configured to determine the reference value of the energizing time by determining a value of an energizing time corresponding to the corrected value of the requested fuel quantity, and performing a second learning cycle. The second learning cycle may include performing a fuel injection by energizing the fuel injector for the determined value of energizing time, measuring a value of an oxygen concentration in an exhaust gas, increasing the determined value of the energizing time by a predetermined amount and repeat the second learning cycle, if the measured value of the oxygen concentration is larger than an expected value thereof, decreasing the determined value of the energizing time by the predetermined amount and repeat the second learning cycle, if the measured value of the oxygen concentration is smaller than the expected value, and identifying the determined value of the energizing time as the reference value thereof, if the measured value of the oxygen concentration is equal to the expected value thereof.

As a result of this solution, also the second learning cycle, which may be a standard and known learning cycle, having as input the value of the energizing time determined on the basis of the corrected value of the requested fuel quantity which is an output of the last of the first learning cycles, may have a faster learning convergence and may be more accurate than the known learning cycles.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
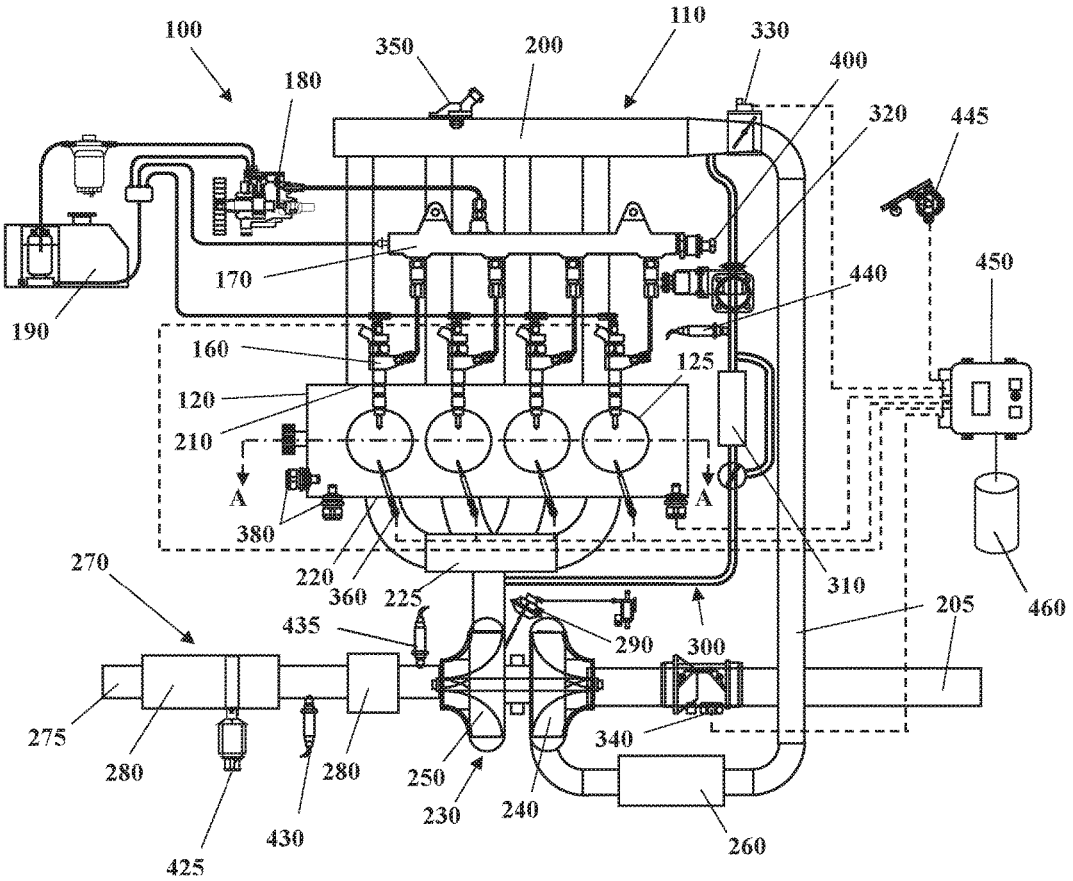
FIG. 1 shows an automotive system.
Figure 2:
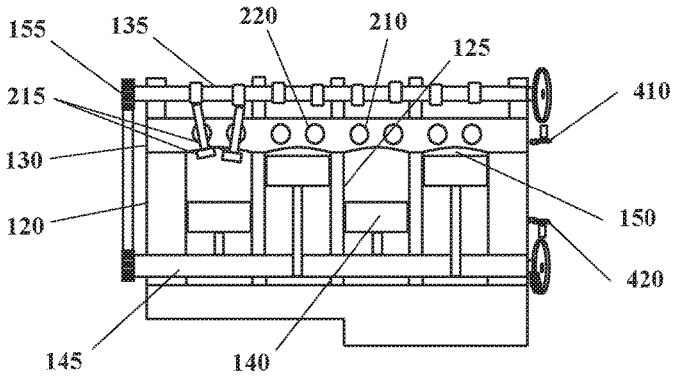
FIG. 2 is a cross-section of an internal combustion engine belonging to the automotive system of FIG. 1.

Some embodiments may include an automotive system 100, as shown in FIGS. 1 and 2, that includes an internal combustion engine (ICE) 110 having a cylinder block 120 defining at least one cylinder 125 having a piston 140 coupled to rotate a crankshaft 145. A cylinder head 130 cooperates with the piston 140 to define a combustion chamber 150.

A fuel and air mixture is injected in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190.

Each of the cylinders 125 has at least two valves 215, actuated by a camshaft 135 rotating in time with the crankshaft 145. The valves 215 selectively allow air into the combustion chamber 150 from the intake port 210 and alternately allow exhaust gases to exit through an exhaust port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle valve 330 may be provided to regulate the flow of air into the intake manifold 200. In still other embodiments, a forced air system such as a turbocharger 230, having a compressor 240 rotationally coupled to a turbine 250, may be provided. Rotation of the compressor 240 increases the pressure and temperature of the air in the air intake duct 205 and intake manifold 200. An intercooler 260 disposed in the air intake duct 205 may reduce the temperature of the air.

The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust gas aftertreatment system 270. This example shows a variable geometry turbine (VGT) 250 with a VGT actuator 290 arranged to move the vanes to alter the flow of the exhaust gases through the turbine 250.

The exhaust gas aftertreatment system 270 may include an exhaust pipe 275 having one or more exhaust aftertreatment devices 280. The aftertreatment devices 280 may be any device configured to change the composition of the exhaust gases. Some examples of aftertreatment devices 280 include, but are not limited to, catalytic converters (two and three way), oxidation catalysts, lean NOx traps, hydrocarbon absorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow, pressure, temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, an exhaust temperature sensor 425, an EGR temperature sensor 440, and an accelerator pedal position sensor 445. The sensors may also include an exhaust gas pressure sensor 430, which is located in the exhaust pipe 275 for measuring a pressure therein, and an oxygen sensor 435, for example an Universal Exhaust Gas Oxygen (UEGO) sensor or a lambda sensor or a nitrogen oxides sensor, for measuring an oxygen concentration in the exhaust gas present in the exhaust gas aftertreatment system 270.

Furthermore, the ECU 450 may generate output signals to various control devices that are arranged to control the operation of the ICE 110, including, but not limited to, the fuel injector 160, the throttle valve 330, the EGR Valve 320, the VGT actuator 255, and the cam phaser 155. Note, dashed lines are used to indicate communication between the ECU 450 and the various sensors and devices, but some are omitted for clarity.

Turning now to the ECU 450, this apparatus may include a digital central processing unit (CPU 460) in communication with a memory system and an interface bus. The CPU is configured to execute instructions stored as a program in the memory system, and send and receive signals to/from the interface bus. The memory system may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system is transmitted from outside via a cable or in a wireless fashion. Outside the automotive system 100 it is normally visible as a computer program product, which is also called computer readable medium or machine readable medium in the art, and which should be understood to be a computer program code residing on a carrier, the carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulated technique such as QPSK for digital data, such that binary data representing the computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible, computer readable storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic, e.g. an embedded controller, an onboard computer, or any processing module that might be deployed in the vehicle.

One of the tasks of the ECU 450 may be that of controlling and correcting the amount of fuel the fuel injector 160 injects. This test may be performed while the vehicle is in overrun, namely a condition in which the vehicle is travelling but no fuel is injected in the combustion chamber 150 of the ICE 110 (in other words a fuel cut-off condition). Generally, the vehicle is in overrun when the accelerator pedal is completely released.

Figure 3:
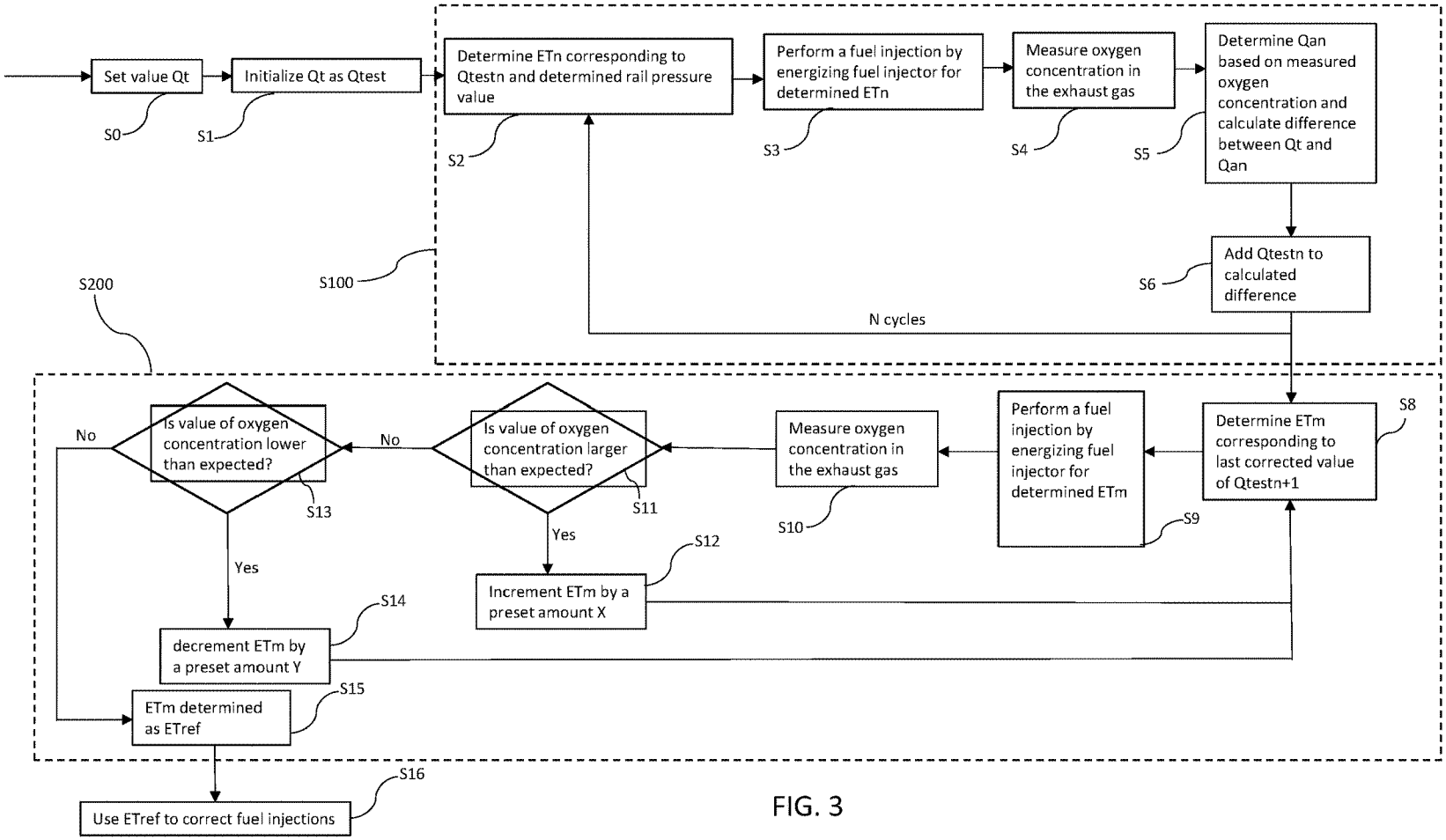
FIG. 3 is a flowchart of a method of controlling an amount of fuel to be injected by a fuel injector into a combustion chamber of an internal combustion engine, according to an embodiment of the present disclosure.

As shown in the flowchart of FIG. 3, the ECU 450, during the above the fuel cut-off condition, is configured to determine a set-point value of the fuel pressure into the fuel rail 170 and to operate the high pressure fuel pump 180 in order to deliver fuel into the fuel rail 170 until a measured pressure value into the fuel rail is equal to the determined set-point value. The set-point value may be a value pre-calibrated during experimental activities performed on a test bench and stored in the memory system. The pressure value may be measured by means of the fuel rail pressure sensor 400.

Again, the ECU 450 is configured to set (block S0) a value Qt of a target (small) quantity of fuel to be injected by the fuel injector 160 into the combustion chamber 150. In particular, the value Qt of the target fuel quantity may be a value pre-calibrated during experimental activities performed on a test bench and stored in the memory system, such for example 2 $mm^3$ of fuel.

The ECU 450 is then configured to initialize (block S1) the value Qt of the target fuel quantity as an initial value Qtest of a fuel quantity requested from the fuel injector 160.

In practice, the ECU 450 firstly provides for initializing the requested value Qtest (namely a first test value) of the fuel requested quantity at the value Qt of the target fuel quantity to be injected by the fuel injector 160. The initial value Qtest of the fuel requested quantity may be stored in the memory system and read therefrom by the ECU 450.

When the measured pressure value into the fuel rail 170 is equal to the determined set-point value, the ECU 450 is configured to execute a compensating strategy which corrects the injection drifts of the fuel injectors 160. This compensating strategy includes a first learning cycle S100 as disclosed hereinafter.

The first learning cycles provides for the ECU 450 to determine (block S2) a value $ET_n$ of an energizing time corresponding to the value $Qtest_n$ of the fuel requested quantity and the determined rail pressure set-point value. In particular, the value $Qtest_1$ of the first cycle (n=1) of the first learning cycles is initialized as disclosed above and is equal to the value Qt of the target fuel quantity. By way of example, for each rail pressure set point value the value $ET_n$ of the energizing time may be provided as an output of a pre-calibrated map which receives as an input the requested value $Qtest_n$. This map may be pre-determined during experimental activities performed on a test bench and stored in the memory system.

Once the value $ET_n$ of the energizing time is determined, the ECU 450 is configured to perform (block S3) a fuel injection by energizing the fuel injector 160 for the determined value $ET_n$ of the energizing time. The fuel injection may be constituted by a single fuel injection or by a sequence of fuel injection pulses.

In practice, when the fuel injector 160 is energized a certain quantity of fuel is actually injected into the combustion chamber 150 during the performed fuel injection. This injected fuel quantity may be different from the requested fuel quantity, for example due to ageing of the fuel injector 160 and need to be determined.

The first learning cycle then provides for the ECU 450 to measure (block S4), by means of the oxygen sensor 435, a value $\lambda m_n$ of the oxygen concentration in the exhaust gas generated by a combustion in the combustion chamber 150 of the fuel injected quantity. The first learning cycle provides for the ECU 450 to determine (block S5) a value $Qa_n$ of the fuel injected quantity as a function of the measured value $\lambda m_n$ of the oxygen concentration. By way of an example, the value $Qa_n$ of the fuel injected quantity (e.g. a volume quantity) may be calculated by means of the following formula:

$$Qa_n = k\frac{\dot{m}}{\lambda m_n},$$

Wherein $\dot{m}$ is an amount of air disposed into the combustion chamber 150 during the performed fuel injection (e.g. a mass amount). The amount of air disposed into the combustion chamber 150 ($\dot{m}$) may be measured by the mass airflow, pressure, temperature sensor 340 or may be assumed as a constant value pre-determined during experimental activities performed on a test bench and stored in the memory system. The proportionality constant k may be calculated according the following formula:

$$k = \frac{Nc/Np}{\alpha s * \rho},$$

Wherein Nc is the number of combustion chambers 150 of which the ICE 110 is equipped, Np is the number of energizing pulses of the sequence of fuel injection pulses executed by fuel injector 160 during the performed fuel injection, as is the value of the stoichiometric air to fuel ratio and ρ is a value of the density of the fuel. The number (Nc) of combustion chambers 150, the number (Np) of energizing pulses, the value (ρ) of the density of the fuel, and the value (αs) of the stoichiometric air to fuel ratio may be values pre-determined, i.e. known from literature or pre-measured or pre-calibrated on a test bench, and stored in the memory system.

As an alternative example, the value ($Qa_n$) of the fuel injected quantity may be estimated as a function of the measured value ($\lambda m_n$) of the oxygen concentration. In this case the value ($Qa_n$) may be provided as an output of a pre-calibrated map which receives as an input the measured value ($\lambda m_n$) of the oxygen concentration. This map may be pre-determined during experimental activities performed on a test bench and stored in the memory system.

Once the value ($Qa_n$) of the fuel injected quantity is determined, the first learning cycles provides for the ECU 450 to calculate (block S5) a difference (Δn) between the value (Qt) of the target fuel quantity and the value ($Qa_n$) of the fuel injected quantity and, then, to add (block S6) the value ($Qtest_n$) of the requested fuel quantity to the calculated difference ($\Delta_n$). In particular, in order to add the requested value ($Qtest_n$), the ECU 450 is configured to calculate a corrected value ($Qtest_{n+1}$) as the sum of the previous requested value ($Qtest_n$) and the calculated difference ($\Delta_n$).

The ECU 450 is configured to repeat the first learning cycle a discrete number of times, from 1 to a natural number (N), which, may be a value pre-calibrated during experimental activities performed on a test bench and stored in the memory system, such for example a number less than five, and preferably three. After the last cycle (N) of the first learning cycles the last corrected value ($Qtest_{n+1}$) may be stored in the memory system. Moreover, the ECU 450 is configured to determine (block S8) a value ($ET_m$) of an energizing time corresponding to the last corrected value ($Qtest_{n+1}$) of the requested fuel quantity stored in the memory system.

By way of example, the value ($ET_m$) of the energizing time may be provided as an output of a pre-calibrated map which receives as an input to the last corrected value ($Qtest_{n+1}$) of the last cycle (N) of the first learning cycles. This map may be pre-determined during experimental activities performed on a test bench and stored in the memory system and may be the same map used for determining the value ($ET_n$) of the energizing time in the first learning cycle.

Afterward, the compensating strategy provides for the ECU 450 to perform a second learning cycle (S200), disclosed as follow, which follows the last cycle (N) of the first learning cycles. In particular, once the value ($ET_m$) of the energizing time is determined, the ECU 450 is configured to perform (block S9) a fuel injection by energizing the fuel injector 160 for the determined further value ($ET_m$) of the energizing time. This fuel injection may be constituted by a single fuel injection or by a sequence of fuel injection pulses.

The second learning cycles then provides for the ECU 450 to measure (block S10), by means of the oxygen sensor 435, a value ($\lambda m_m$) of the oxygen concentration in the exhaust gas generated by a combustion in the combustion chamber 150 of the fuel quantity actually injected during the performed fuel injection. The second learning cycles provides for the ECU 450 to correct the determined value ($ET_m$) of the energizing time, if the measured value ($\lambda m_n$) of the oxygen concentration differs from an expected value ($\lambda m_e$) thereof. The expected value ($\lambda m_e$) of the oxygen concentration may be an empirically determined value pre-determined during experimental activities performed on a test bench and stored in the memory system.

By way of an example in order to check if the measured value ($\lambda m_m$) of the oxygen concentration differs from the expected value ($\lambda m_e$), the measured value ($\lambda m_m$) of the oxygen concentration may be applied to a first condition block S11, which checks if the measured value ($\lambda m_m$) of the oxygen concentration is larger than the expected value ($\lambda m_e$) possibly allowing a little tolerance. If the first condition block S11 returns positive, it means that the fuel injector 160 operated for the determined value ($ET_m$) of the energizing time has injected a fuel quantity lower than expected. In this case, the ECU 450 is configured to increment (block S12) the value ($ET_m$) of a preset amount X (e.g., pre-determined during experimental activities performed on a test bench and stored in the memory system), and then of repeating the second learning cycle using this incremented value ($ET_m$+X) of the energizing time.

If conversely the first condition block S11 returns negative, the measured value ($\lambda m_m$) of the oxygen concentration is applied to a second condition block S13, which checks if the measured value ($\lambda m_m$) of the oxygen concentration is lower than the expected value ($\lambda m_e$) possibly allowing a little tolerance. If the second condition block S13 returns positive, it means that the fuel injector 160 operated for the determined value ($ET_m$) of the energizing time has injected a fuel quantity greater than expected. In this case, the ECU 450 is configured to decrement (block S14) the value ($ET_m$) of a preset amount Y (e.g., pre-determined during experimental activities performed on a test bench and stored in the memory system), and then of repeating the second learning cycle using this decremented value ($ET_m$+Y) of the energizing time.

In other words, the value ($ET_m$) of energizing time is adjusted and the second learning cycle is repeated, until a correct value ($ET_{mc}$) of the energizing time is found for which both the condition blocks S11 and S13 return negative. When both the condition blocks S11 and S13 return negative, it means that the measured value ($\lambda m_m$) of the oxygen concentration is equal to the expected value ($\lambda m_e$) thereof (or within a little range of tolerances across 1), and the value ($ET_m$) of the energizing time that satisfies this condition is identified (block S15) as a reference value ($ET_{ref}$) of the energizing time. The reference value ($ET_{ref}$) is memorized in the memory system and a learning phase constituted by the first and the second learning cycles is ended. Afterwards, the memorized reference value ($ET_{ref}$) of the energizing time may be used (block S16) to correct other fuel injections performed by the fuel injector 160 during the normal operation of the ICE 110.

More particularly, during the normal operation of the ICE 110, the ECU 450 may control the fuel injector 160 to perform some fuel injections using the strategy disclosed hereinafter. This strategy firstly may provide for the ECU 450 to determine a nominal value (ET) of the energizing time for the fuel injector 160. This nominal value (ET) of the energizing time may be determined as the value that would correspond to a desired quantity of fuel to be injected, if the fuel injector 160 were a nominal operating fuel injector. The strategy further may provide for the ECU 450 to determine a correction factor (CF) as a function of the memorized reference value ($ET_{ref}$) of the energizing time. The correction factor (CF) may be then subtracted from the nominal value (ET) of the energizing time, thereby obtaining a corrected value ($ET_{corr}$) of the energizing time. Finally, the strategy may provide for the ECU 450 to activate the fuel injector 160 for the corrected value ($ET_{corr}$) of the energizing time.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method of operating a fuel injector of an internal combustion engine comprising:

setting a value of a target fuel quantity to be injected by the fuel injector;

initializing a value of a fuel quantity requested from the fuel injector to the value of the target fuel quantity;

correcting the value of the requested fuel quantity, wherein the correction of the value of the requested fuel quantity includes performing a first learning cycle including:

determining a value of an energizing time corresponding to the value of the requested fuel quantity;

performing a fuel injection by energizing the fuel injector for the determined value of energizing time;

measuring a value of an oxygen concentration in an exhaust gas;

determining a value a fuel quantity that has been injected by the fuel injector as a function of the measured value of the oxygen concentration;

calculating a difference between the value of the target fuel quantity and the value of the injected fuel quantity;

adding the value of the requested fuel quantity to the calculated difference to yield a corrected value of the requested fuel quantity;

determining a reference value of an energizing time using the corrected value of the requested fuel quantity for causing the fuel injector to inject the target fuel quantity; and operating the fuel injector based on the determined reference value of the energizing time, wherein the value of the injected fuel quantity is calculated according to the following formula:

$$Qa = k\frac{\dot{m}}{\lambda m}$$

wherein:

Qa is the value of the fuel quantity injected during the fuel injection, $\dot{m}$ is an amount of air disposed into a combustion chamber during the fuel injection, $\lambda m$ is the measured quantity of oxygen concentration, and k is proportionality constant, wherein the proportionality constant is calculated according the following formula:

$$k = \frac{Nc/Np}{\alpha s * \rho}$$

wherein:

k is the proportionality constant,

Nc is a number of combustion chambers of the internal combustion engine,

Np is a number of energizing pulses of the fuel injector to perform a fuel injection, $\alpha s$ is the value of a stoichiometric air to fuel ratio, and $\rho$ is a value of a density of the fuel.

2. The method according to claim 1, wherein the correction of the value of the requested fuel quantity further comprises repeatedly performing the first learning cycle for a predetermined number of times.

3. The method according to claim 2, wherein the predetermined number of times is in the range of three to five times.

4. The method according to claim 1, wherein the determination of the reference value of the energizing time comprises:

determining a value of an energizing time corresponding to the corrected value of the requested fuel quantity; and performing a second learning cycle including:

performing a fuel injection by energizing the fuel injector for the determined value of energizing time;

measuring a value of an oxygen concentration in an exhaust gas;

increasing the determined value of the energizing time by a predetermined amount and repeat the second learning cycle, if the measured value of the oxygen concentration is larger than an expected value thereof;

decreasing the determined value of the energizing time by the predetermined amount and repeat the second learning cycle, if the measured value of the oxygen concentration is smaller than the expected value, and identifying the determined value of the energizing time as the reference value thereof, if the measured value of the oxygen concentration is equal to the expected value thereof.

5. A non-transitory computer readable medium comprising a computer program having programming instructions which when executed on a computer, is configured to:

set a value of a target fuel quantity to be injected by the fuel injector;

initialize a value of a fuel quantity requested from the fuel injector to the value of the target fuel quantity;

correct the value of the requested fuel quantity;

determine a reference value of an energizing time using the corrected value of the requested fuel quantity for causing the fuel injector to inject the target fuel quantity;

operate the fuel injector based on the determined reference value of the energizing time;

wherein the correction of the value of the requested fuel quantity includes performing a first learning cycle including:

determining a value of an energizing time corresponding to the value of the requested fuel quantity;

performing a fuel injection by energizing the fuel injector for the determined value of energizing time;

measuring a value of an oxygen concentration in an exhaust gas;

determining a value a fuel quantity that has been injected by the fuel injector as a function of the measured value of the oxygen concentration;

calculating a difference between the value of the target fuel quantity and the value of the injected fuel quantity; and adding the value of the requested fuel quantity to the calculated difference to yield a corrected value of the requested fuel quantity;

wherein the computer program further comprises programming instructions which when executed on a computer, is configured to:

calculate the value of the injected fuel quantity according to the following formula:

$$Qa = k\frac{\dot{m}}{\lambda m}$$

wherein:

Qa is the value of the fuel quantity injected during the fuel injection, $\dot{m}$ is an amount of air disposed into a combustion chamber during the fuel injection, λm is the measured quantity of oxygen concentration, and k is a proportionality constant calculated according the following formula:

$$k = \frac{Nc/Np}{\alpha s * \rho}$$

wherein:

k is the proportionality constant,

Nc is a number of combustion chambers of the internal combustion engine,

Np is a number of energizing pulses of the fuel injector to perform a fuel injection, αs is the value of a stoichiometric air to fuel ratio, and ρ is a value of a density of the fuel.

6. An internal combustion engine comprising a combustion chamber, a fuel injector, an exhaust gas aftertreatment system, an oxygen sensor and an electronic control unit operably coupled to the fuel injector and the oxygen sensor, the electronic control unit configured to:

set a value of a target fuel quantity to be injected by the fuel injector;

initialize a value of a fuel quantity requested from the fuel injector to the value of the target fuel quantity;

correct the value of the requested fuel quantity;

determine a reference value of an energizing time using the corrected value of the requested fuel quantity for causing the fuel injector to inject the target fuel quantity;

operate the fuel injector based on the determined reference value of the energizing time;

wherein the correction of the value of the requested fuel quantity includes performing a first learning cycle including:

determining a value of an energizing time corresponding to the value of the requested fuel quantity;

performing a fuel injection by energizing the fuel injector for the determined value of energizing time;

measuring a value of an oxygen concentration in an exhaust gas;

determining a value a fuel quantity that has been injected by the fuel injector as a function of the measured value of the oxygen concentration;

calculating a difference between the value of the target fuel quantity and the value of the injected fuel quantity; and adding the value of the requested fuel quantity to the calculated difference to yield a corrected value of the requested fuel quantity;

wherein the electronic control unit is configured to:

calculate the value of the injected fuel quantity according to the following formula:

$$Qa = k\frac{\dot{m}}{\lambda m}$$

wherein:

Qa is the value of the fuel quantity injected during the fuel injection, $\dot{m}$ is an amount of air disposed into a combustion chamber during the fuel injection, λm is the measured quantity of oxygen concentration, and k is a proportionality constant calculated according the following formula:

$$k = \frac{Nc/Np}{\alpha s * \rho}$$

wherein:

k is the proportionality constant,

Nc is a number of combustion chambers of the internal combustion engine,

Np is a number of energizing pulses of the fuel injector to perform a fuel injection, αs is the value of a stoichiometric air to fuel ratio, and ρ is a value of a density of the fuel.

* * * * *